US006131417A

United States Patent [19]

Plath et al.

[11] Patent Number: 6,131,417

[45] Date of Patent: Oct. 17, 2000

[54] CIRCULAR KNITTING MACHINE WITH AN EXCHANGEABLE NEEDLE CYLINDER

[75] Inventors: Ernst-Dieter Plath, Albstadt; Stefan Seeger, Jungingen; Dietmar Tränkle, Balingen; Kurt Jüntner, Bitz, all of Germany

[73] Assignee: Sipra Patententwicklungs-U. Beteiligungsgesellschaft mbH, Albstadt, Germany

[21] Appl. No.: 08/993,978

[22] Filed: Dec. 18, 1997

[30] Foreign Application Priority Data

Dec. 20, 1996 [DE] Germany ..... 196 53 761

[51] Int. Cl.[7] ..... D04B 9/02

[52] U.S. Cl. ..... 66/19

[58] Field of Search ..... 66/19, 8, 1 R

[56] References Cited

U.S. PATENT DOCUMENTS

| | | | |
|---|---|---|---|
| 1,745,678 | 2/1930 | Howie | 66/19 |
| 3,491,556 | 1/1970 | Mishcon | 66/19 |
| 3,757,538 | 9/1973 | Marinetz | 66/19 |
| 5,099,661 | 3/1992 | Kitagawa | 66/19 |
| 5,224,360 | 7/1993 | Kawase et al. | 66/19 |

FOREIGN PATENT DOCUMENTS

| | | |
|---|---|---|
| 177 577 | 1/1906 | Germany . |
| 0 436 313 B1 | 7/1991 | Germany . |
| 0 413 608 B1 | 11/1994 | Germany . |

*Primary Examiner*—Andy Falik
*Attorney, Agent, or Firm*—Michael J. Striker

[57] ABSTRACT

A circular knitting machine has a knitting frame, a supporting ring mounted on the machine frame, a needle cylinder supported on the supporting ring. The needle cylinder has a needle cylinder axis and an upper and a lower edge. A carrier shaft is mounted in the machine frame coaxial to the needle axis, a component is mounted on a lower end of the carrier shaft, and a device is provided for moving the needle cylinder relative to the component in the direction of the needle carrier axis so that the needle cylinder can be disassembled or assembled by motions substantially perpendicular to the needle cylinder axis and so that the needle cylinder is movable into an operating position and an assembly position allowing assembly and/or disassembly.

21 Claims, 9 Drawing Sheets

CIRCULAR KNITTING MACHINE WITH AN EXCHANGEABLE NEEDLE CYLINDER

BACKGROUND OF THE INVENTION

The present invention relates to a circular knitting machine and, more particularly, to a circular knitting machine comprising a machine frame, a supporting ring mounted on the frame, a needle carrier supported on the supporting ring and having a needle carrier axis and upper and lower edge, a carrier shaft mounted in the frame coaxial to the axis, a component mounted on a lower end of the carrier shaft and a device for adjusting the relative position of the needle carrier and the component in the direction of the needle carrier axis so that the needle carrier can be disassembled or assembled by motions substantially perpendicular to the needle carrier axis as required.

Circular knitting machines with exchangeable needle cylinders have been known for a comparatively long time in the art, for example as described in German Patent 177 577.

In as much as the circular knitting machine has only one needle cylinder, its assembly and disassembly is comparatively easy. Besides assembly and disassembly this serves both repair and maintenance purposes as well as the purpose of operating the same knitting machine with needle cylinders of different gange and/or different diameter. Since the space above the needle cylinder is largely free, the needle cylinder and, if necessary the associated supporting ring needs to be lifted out or removed and inserted only from above the machine frame.

In contrast the assembly and disassembly of needle cylinders from above is not possible without further ado, when the circular knitting machine also has a component arranged above the needle cylinder, e.g. a dial or a yarn changing device, since then a removal of a component of this type would require the almost complete disassembly of the entire circular knitting machines For this case a device has already been provided and disclosed in European Patents EP 0 413 608 A1 and EP 0 436 313 A1, by means of which the relative position of the needle cylinder and the component above it is adjustable in a direction of the needle cylinder axis so that the needle cylinder can be disassembled or assembled by movements in a direction extending perpendicular to the needle cylinder axis, and indeed with or without the above-named component as desired. The device contains means by which the component can be moved upward far enough from the needle cylinder so that assembly or disassembly of the needle cylinder can occur from the side. The means for raising the above-mentioned component comprises, e.g., a conventionally present device for adjustment of the loop size by axial relative shifting of the component, especially when it is a dial.

A problem with this type of circular knitting machine which has not been solved up to now is that the assembly and disassembly of the needle cylinder itself is not easily possible even if the component is raised or lifted. A reason for this is that the needle cylinder is arranged with its lower edge generally in a recess in the cylinder ring and/or is provided with additional centering means which require a considerable lifting of the needle cylinder in disassembly and a corresponding lowering during assembly of the needle cylinder. These motions must be performed manually by operating persons handling the structural changes. Assembly and disassembly steps are then particularly difficult when the needle cylinder still is burdened by a component on it, e.g. a dial.

SUMMARY OF THE INVENTION

It is an object of the present invention to provide a circular knitting machine of the above-described type which is designed so that an assembly and disassembly of the needle cylinder can be easily performed independently of whether it is equipped with a dial or other component or not.

A further object of this invention is to design the circular knitting machine such that assembly and disassembly of the needle cylinder can be performed without excessive relative adjustment of the dial or other component.

A further object of the invention is to provide the knitting machine with means to guide and support the needle cylinder when it is removed from and again mounted within the machine frame.

Yet another object of the invention is to provide the knitting machine with means assisting the assembly and disassembly of the dial or other component.

These objects, and others which be made more apparent hereinafter are attained in a circular knitting machine comprising a machine frame, a supporting ring mounted on the frame, a needle carrier supported on the supporting ring and having a needle carrier axis and an upper and a lower edge, a carrier shaft mounted in the machine frame coaxial to the needle carrier axis, a component mounted on a lower end of the carrier shaft and a device for adjusting the relative position of the needle carrier and the component in the direction of the needle carrier axis so that the needle carrier can be disassembled or assembled by motions substantially perpendicular to the needle carrier axis as required.

According to the invention, the circular knitting machine includes means for moving the needle carrier in an axial direction at least into an operating position and an assembly position allowing assembly and/or disassembly.

The invention has the advantage that the needle carrier, e.g. needle cylinder, itself is axially movable, not the component, and can be brought into a position in which it is possible to assembly and disassembly it without manually raising or lowering in the axial direction.

Preferred embodiments of the invention and other advantageous features are included in the dependent claims appended hereinbelow and in the following detailed description.

A preferred embodiment of the circular knitting machine according to the invention includes at least two guide rails defining the assembly position and being mounted on the supporting ring and/or a cam plate associated with the needle carrier. The needle carrier is placed on the at least two guide rails in the assembly position. Advantageously the assembly position of the needle carrier is not below a plane passing through an upper side of the supporting ring and/or the cam plate. In various preferred embodiments the component is a dial and the space or distance between the operating position and the assembly position of the needle carrier is large enough so that the needle carrier is removable from the machine frame also with the dial on the upper side of the needle carrier. The dial is releasably attached to the lower or bottom side of a dial supporting plate provided on the lower end of the carrier shaft.

In one preferred embodiment of the circular knitting machine the means for moving the needle carrier relative to the component in the direction of the needle carrier axis includes a removable spacer by which the needle carrier is supported in the operating position on the supporting ring. Preferably the means for moving the needle carrier relative to the component in the direction of the needle carrier axis includes lifting screws by means of which the needle carrier is liftable into a spacer removal position allowing removal of the spacer. In another preferred embodiment the means for moving the needle carrier relative to the component in the direction of the needle carrier axis includes at least two lifting and guiding rails having round cross-sections mounted between the needle cylinder and the supporting ring and/or a cam plate, by means of which the needle carrier is liftable into a spacer removal position allowing removal of the spacer.

Advantageously the spacer is provided with centering means for the needle carrier. The spacer preferably in one embodiment includes a plurality of spacing pieces arranged around the supporting ring, and attachment screws are provided for releasably attaching the spacing pieces with supporting ring. On the other hand, the supporting ring is provided with centering elements for the needle carrier. The centering elements preferably are provided on a centering ring, advantageously in at least two ring segments, mounted on the supporting ring movable parallel to the needle carrier axis.

The means for moving the needle carrier relative to the component in the direction of the needle carrier axis advantageously includes a supporting element bearing on the lower edge of the needle support rotatably mounted on the supporting ring and the supporting element has an outer threaded portion which is screwed into an interior threaded portion of the supporting ring.

In a preferred embodiment guide grooves for the at least two guide rails are provided in the lower edge of the needle carrier and/or an upper side of the supporting ring and/or the cam plate. A guide frame for supporting portions of the at least two guide rails is advantageously provided and extends radially beyond the machines frame and rests or bears on the machine frame.

BRIEF DESCRIPTION OF THE DRAWING

The objects, features and advantages of the invention are explained in more detail in the following description of the preferred embodiments with reference to the accompanying drawing in which.

DESCRIPTION OF THE PREFERRED EMBODIMENTS

Figure 1:
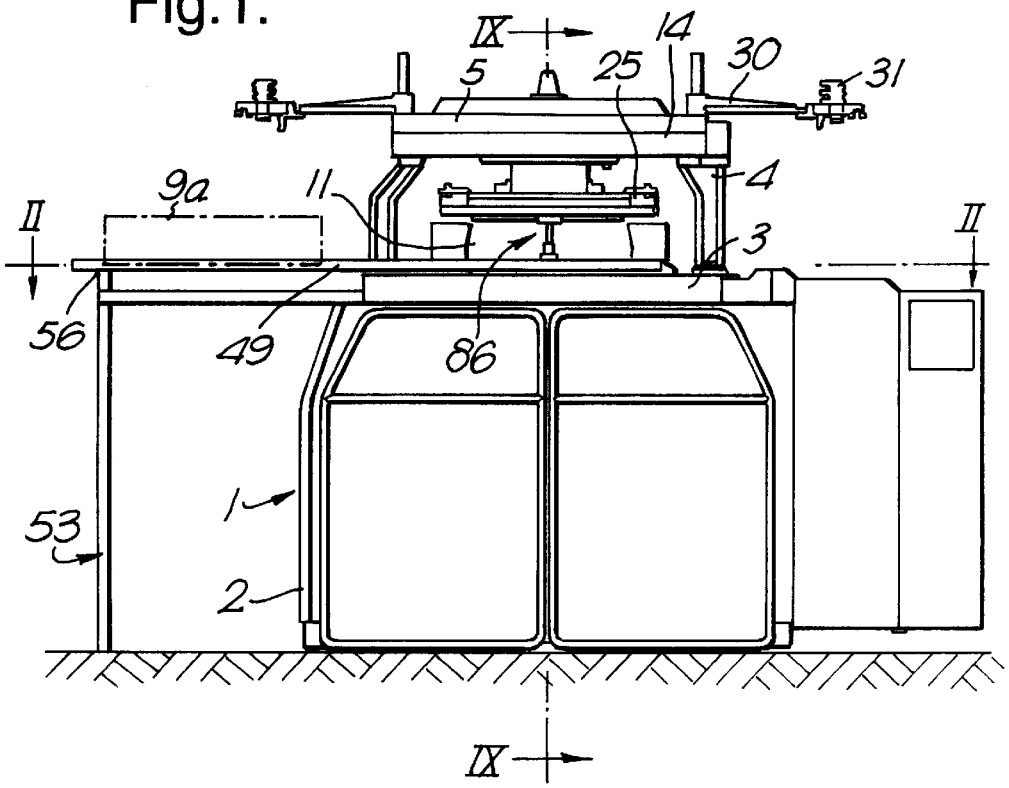
FIG. 1 is a front view of a circular knitting machine according to the invention.
Figure 2:
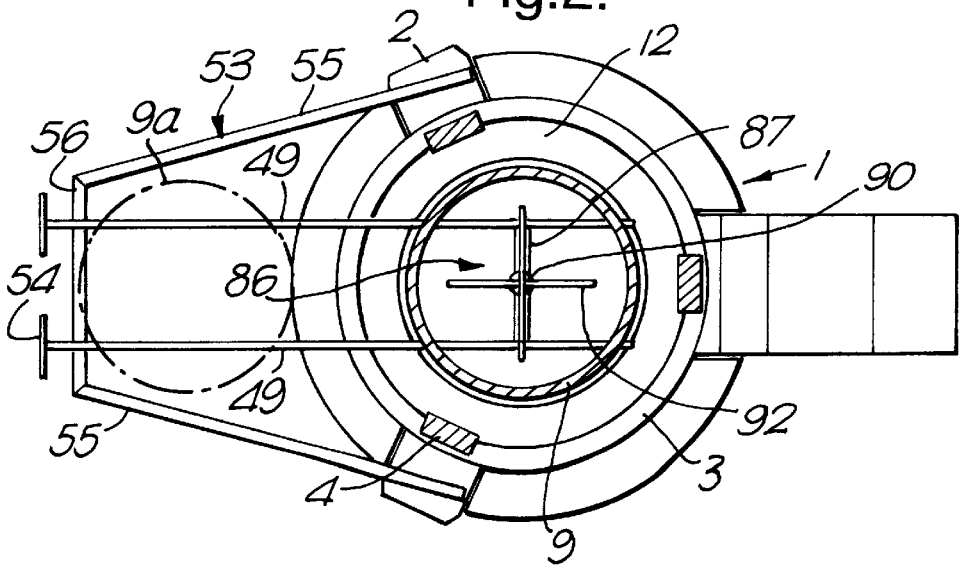
FIG. 2 is a cross-sectional view of the machine as shown in FIG. 1 taken along the section line II—II of FIG. 1.
Figure 3:
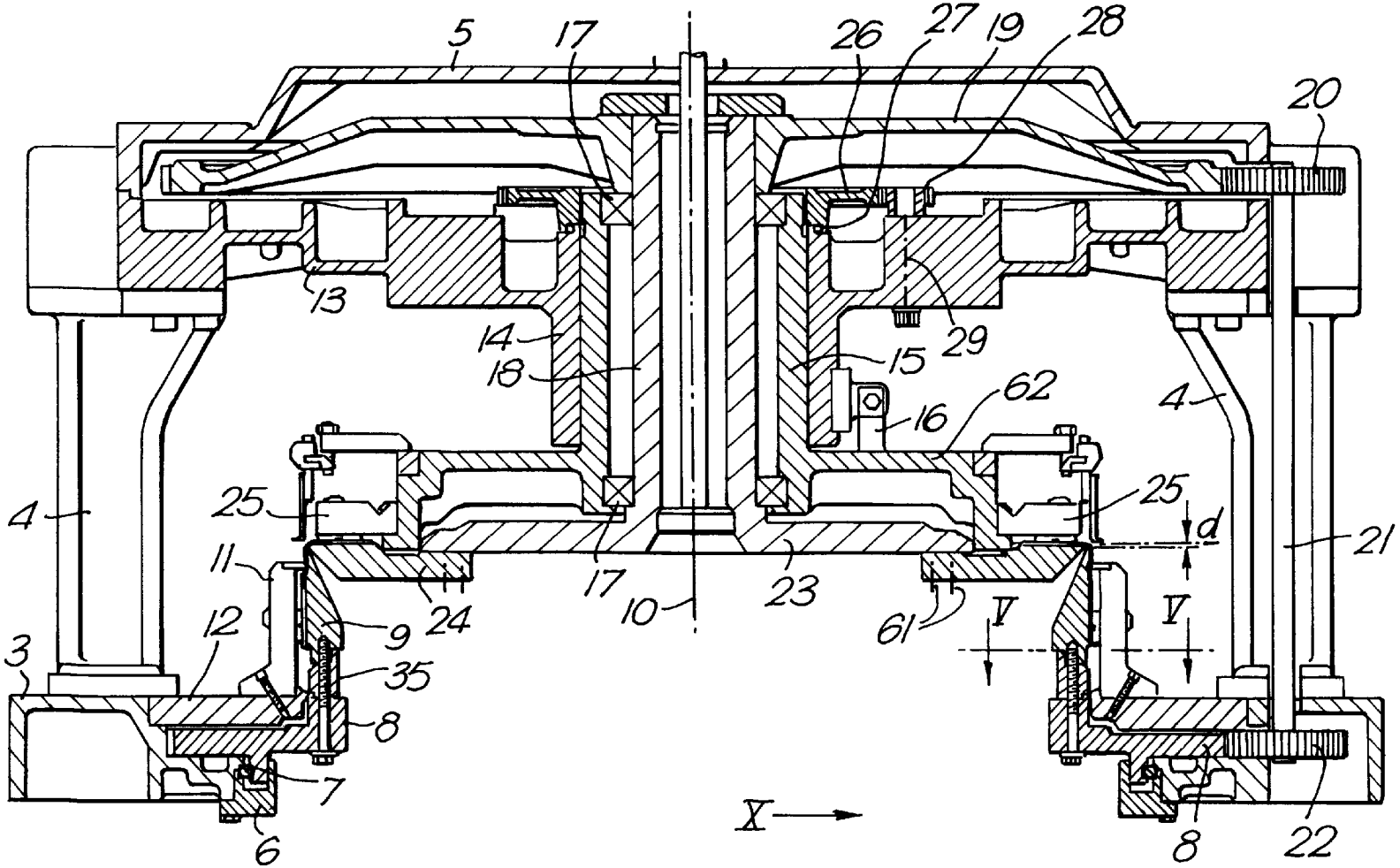
FIG. 3 is a detailed vertical cross-sectional view through a part of the circular knitting machine according to the invention which has a needle cylinder ans a dial.

According to FIGS. 1 to 3 a circular knitting machine contains a machine frame 1 which has a circular base plate 3 supported on frame feet 2, which supports a plurality of substantially vertical supporting columns 4 distributed circumferentially, which are covered by a cover 5 on their upper ends. A circular flange body is connected with the underside of the base plate 3, which forms a bearing surface for the bearing 7 by means of which a cylinder supporting ring 8 provided with exterior gear teeth is supported rotatably in the base plate 3.

A needle cylinder 9 is supported on the supporting ring 8, which is equipped in a known unshown way with knitting tool, such as knitting needles, plush sinkers or the like and is rotatable about its axis 10 which is usually a central machine axis. The needle cylinder 9 is embraced by a stationary cylinder cam box ring 11. The cam box ring 11 is supported with its bottom side on a cam box plate 12 attached to the base plate 3 and is provided with cam parts acting on the butts of the knitting tools which are not shown in further detail.

An upper frame ring 13 in the upper part of the circular knitting machine connects the supporting columns 4. The frame ring 13 carriers a sleeve 14 coaxial to the axis 10 in which a carrier tube 15 is supported nonrotatably, e.g. by means of arms 16, however axially slidable. A coaxial carrier shaft 18, which is fixed at its upper end with a coaxial drive gear 19 or is made in one piece with it, is mounted in the carrier tube 15 by means of the upper and lower bearing 17 and is rotatable, however axially fixed with respect to the tube 15. The drive gear 19 meshes with a drive pinion 20 so that it can perform limited motions parallel to axis 10 relative to it without disengaging from the pinion 19. The drive pinion 19 is attached at its upper end to a pinion shaft 21, which is rotatably mounted by means of unshown upper and lower bearings in one of the supporting columns 4 and is arranged with its axis parallel to the axis 10. An additional drive pinion 22 is attached to the lower part of the pinion shaft 21, which meshes with the cylinder supporting ring 8 and drives it with the same rotation speed as the drive gear 19 is driven by the drive pinion 20.

An outer flange-like supporting plate 23 is provided on an end of the coaxial carrier shaft 18 protruding from the carrier tube 15, on whose bottom side a component largely covering it and associated with the needle cylinder 9, here a dial 24, is attached. This dial 24 is arranged in a known way coaxial to the axis 10 and provided with unshown knitting tools, especially knitting needles which in contrast to those of the needle cylinder 9 are supported slidable not parallel, but radially, to the axis 10.

A stationary dial cam 25 is located above the dial 24, which is attached to the lower end of the carrier tube 15 and provided with an unshown cam parts. The carrier shaft 18 is arranged rotatable in the carrier tube 15 so that the dial 2 together with the needle cylinder 9 can be rotated relative to the cam devices 11 and 25, when an unshown drive puts the pinion shaft 21 into rotation.

The upper end of the carrier tube 15 is provided with an outer threaded section, on which an inner threaded section of an adjusting ring 26 is engaged to secure the adjusting ring on the carrier tube. The adjusting ring 26 is rotatably supported on the upper side of the frame ring 13 by means of a bearing 27. It has exterior gear teeth which mesh with a gear 28, which is mounted in an only schematically indicated adjusting element 29, e.g. a rotatable bolt, supported in the upper frame ring 13. The gear 28 has a rotation axis extending parallel to axis 10. Thus the carrier tube 15 and the carrier shaft 18 mounted rotatable in it by means of the bearing 17 can perform limited parallel motions parallel to axis 10 relative to the needle cylinder 9. These parallel motions occur by rotation of the adjusting element 29 and with it also the gear 28, as is desired for adjusting the loop size or the so-called comb spacing d (FIG. 3), i.e. the spacing between the upper front surface or the upper knocking-over edges for the loops of the needle cylinder 9 and the bottoms of the grooves formed in the dial 2 receiving the knitting tools.

The circular knitting machine according to FIG. 1 is completed by a rim 30 attached above the cover S of the machine frame 1, which carries schematically indicated yarn guides 31 or the like for guiding the yarn required for knitting to the knitting needles.

The component 2 shown in the embodiment as a dial can alternatively be a sinker ring or the like or a support of a yarn changing device or of a controlling means of it, and this component 24 can be rotatably or stationary mounted in the machine frame 1 and cover the needle cylinder 9 in a known way above it so that the needle cylinder 9 can not be assembled and disassembled without additional disassembly of the component 2 and numerous other components of the circular knitting machine.

Circular knitting machines of this type are generally known to those skilled in the knitting machine arts, e.g. from German Patent Applications DE-OS 1 994 454, DE 41 28 372 A1 and DE 195 11 949 A1 and European Patent Applications EP 0 413 608 A1 and EP 0 436 313 A1, whose subject matter is explicitly incorporated here by reference—in so far as required—to avoid repetition of their subject matter which is already known in the art.

In order to make a simple assembly and/or disassembly of the needle cylinder possible despite the troublesome component 2, a device for adjustment of the relative position of the needle cylinder 9 and the dial 24 in the direction of the axis 10 has means according to the invention by which the needle cylinder 9 is adjustable at least in a normal operating position, as shown e.g. in FIG. 3, and an assembly position (FIG. 11) allowing assembly and disassembly, in which the needle cylinder 9 is assembled or disassembled by motions occurring essentially perpendicular to the axis 10. This is explained in the two following embodiments.

Figure 4:
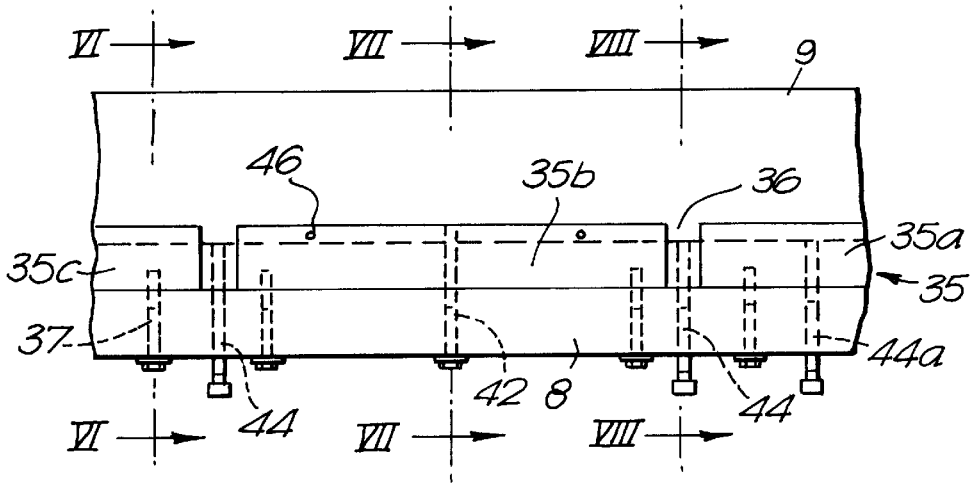
FIG. 4 is a plan view of the device shown in 3 in the direction of the arrow x in FIG. 3 showing the structure of the needle cylinder of the circular knitting machine according to FIG. 3.
Figure 5:
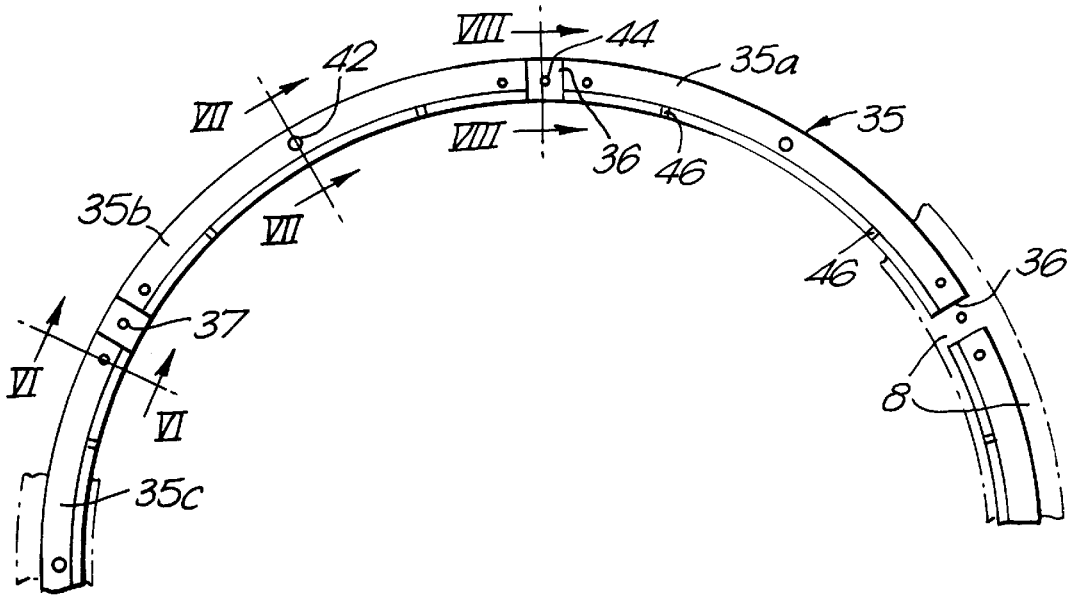
FIG. 5 is a detailed plan view of a half of a supporting ring and a retaining member arranged on it in the circular knitting machine shown in FIG. 3.

According to a first embodiment (FIGS. 1 to 11), the needle cylinder 9 is supported in its normal operating position (FIG. 3) by means of a removable spacer 35 on the advantageously flat upper side of the supporting ring 8. The spacer 35 comprises a plurality of spacing pieces 35*a*, 35*b* and/or 35*c* appropriately formed as ring segments distributed over the circumference of the supporting ring 8 which are spaced from each other advantageously by gaps 36. The spacing pieces 35*a* to 35*c* are, as shown in FIGS. 4 and 5 in the vicinity of the section lines VI—VI and FIG. 6, attached to the supporting ring 8 by means of attaching screws 37, which project from below through the vertical holes 38 of the supporting ring 8 with some play, engage in threaded passages in the spacing pieces 35*a* to 35*c* and bear with their heads on the bottom side of the supporting ring 8. An axially projection centering shoulder 39 extending from the upper surface of the supporting ring 8 and being circumferentially divided or circular acts to center the spacing pieces 35*a* to 35*c* radially. As shown in FIGS. 4 and 5 and FIG. 7, each spacing piece 35*a* to 35*c* has at least one vertical through-going hole 40, which are aligned with a corresponding hole 41 in the supporting ring 8 and an attachment screw 42 can be received in them with play, which is rotatably engaged in an associated threaded passage of the needle cylinder 9. The heads of the attachment screws 42 can contact on the underside of the supporting ring 8. Finally and according to the section lines VIII—VIII in FIGS. 4 and 5 and/or FIG. 8, the supporting ring 8 has threaded passages 43, in which lifting screws 44 are screwed in from below. The threaded passages 43 and the lifting screws 44 are, as shown in FIGS. 4, 5 and 8, arranged in the gaps 36 between two spacing pieces 35*a* to 35*c*. However as indicated also in FIG. 4 the lifting screw 44*a* can be extended with play through a longitudinal hole open on one side or the like in the associated spacing piece. Moreover of course a lifting screw 44 must not be provided in each gap.

The spacing pieces 35*a*, 35*b* and 35*c* each have a protruding shoulder 45 extending over the lower edge of the needle cylinder 9 on its inner side for radial centering of the needle cylinder 9. The shoulder 5 is provided with a number of radial threaded passages distributed around the circumference with centering means in the form of centering screws 46 (FIGS. 4,5,7) inserted in them. Thus the shoulder 45 can extend over the entire length of the respective spacing pieces or can be divided along a circumferential direction on the associated spacing piece or shortened.

The assembly and disassembly of the needle cylinder 9 of the circular knitting machine can be performed according to the following way:

First the attachment screws 42 (FIG. 7), by means of which the needle cylinder 9 is secured over the spacer 35 on the supporting ring 8 and held in its usual operating position, are loosened from below. The centering screws 46 are withdrawn radially toward the inside from the needle cylinder 9. For this a sufficient free space normally present under the needle cylinder 9 of the knitting machine is used or one is provided. After the complete withdrawing of the attachment screws 42 from the associated threaded passages in the needle cylinder 9, the lifting screws 44 are screwed further into the supporting ring 8 until they push against the lower edge or the lower bearing surface 47 of the needle cylinder 9 (FIG. 8). On further screwing in of the lifting screws 44, the needle cylinder 9 is gradually raised parallel to axis 10 (FIG. 3) and because of that is lifted off the spacing pieces 35*a* to 35*c*.

Subsequently the attaching screws 37 are turned out from the associated threaded passages of the spacing pieces 35*a,b,c*. The spacing pieces 35*a,b,c* now bear loosely on the supporting ring 8 and can thus be removed toward the sides or advantageously toward the interior or, in as much as the previously mentioned parts of the cylinder cam 11 were disassembled, radially toward the outside. In order to make this possible the lifting screws 4 need only raise the needle cylinder 9 a few tenths of a millimeter, if it is advantageously provided that the spacing pieces 35*a,b,c* can be withdrawn radially toward the inside of the supporting ring; otherwise further axial raising must be performed. After that the lifting screws 44 are rotated in a reverse direction so that the needle cylinder is lowered again and arrives in an assembly position so far below the dial 24 or other components that it can be raised manually from the lifting screws 44. After the required disassembly of the cylinder cam 11 it can be radially taken out between two supporting columns 4 provided with appropriate spacing and radially removed from the machine frame 1.

The described working steps can be performed in the opposite order for assembling of the needle cylinder 9. Thus it is possible to completely withdraw the lifting screws 44 first wholly into the supporting ring 8 and next to put the needle cylinder 9 onto the supporting ring 8, which also goes for the disassembly. The assembly position in this case is defined by the upper side of the supporting ring 8 and/or the upper edge of the centering shoulder 39 (FIGS. 6,8) and/or the upper edge of a shoulder 48 of the cam plate 12 serving for assembly of the cylinder cam 11, depending upon which upper edge is higher, since the needle cylinder 9 must be removed or inserted over these edges on assembly and disassembly without interfering with the dial.

In order to avoid the troublesome manual lifting of the needle cylinder 9 from the machine frame 1, in a further embodiment of the invention (FIGS. 9 to 11), two guide rails 49 are inserted between the lower edge of the needle cylinder 9 and the upper edge of the supporting ring 8, of the centering shoulder 39 and/or the shoulder 48, with the needle cylinder 9 lifted by the lifting screws 44, and the guide rails 49 are arranged like cords on the circle formed by the supporting ring 8. The needle cylinder 9 is then put down on these guide rails 49 by loosening of the lifting screws 44 and can then be withdrawn S laterally without great effort or applied force. In order to attain a neat guiding of another needle cylinder 9 or of the same needle cylinder in the guide rails especially during the subsequent assembly, for this purpose parallel guide grooves 50,51 and/or 52 (FIGS. 9 and 11) arranged according to a circular chord are provided appropriately both in the bottom side of the needle cylinder 9 and also in the upper side of the supporting ring 8 and/or the cam plate 12. The guide grooves 50,51 and/or 52 have a square or rectangular cross-section like the guide rails 49 and prevent the guide rails 49 and/or the needle cylinder 9 from slipping out perpendicular to the axis of the guide rails. Because of that especially during assembly of the needle cylinder 9 it is guaranteed that it can be moved into the desired central position without expending large force and that it can then be completely centered only with the aid of the centering screws 46.

The guide rails 49 can be inserted in the vicinity of the gaps 36 (FIG. 5) or also at other positions. It must only be guaranteed that they do not collide with the lifting screws 44. Also a guide frame 53 can be provided contacting the machine frame 1 in addition to the guide grooves 50, 51 or 52 or instead of them, which also operates to support sections of the guide rails 49 provided with operating levers 54 or the like, and protruding radially from the machine frame 1. The guide frame 53 has e.g. a frame with rods 55 bearing on the frame feet 2 or other parts of the machine frame 1 and with a supporting rod 56 operating as a support for the guide rails 49 running across it. FIGS. 1 and 2 show the guide frame 53 in a state moved into the circular knitting machine, the mounting rails 49 in an inserted state and a needle cylinder 9 in its usual operating position inside the machine and also in a position 9*a* moved out from the machine frame 1. After the assembly and disassembly of the needle cylinder 9 the guide frame 53 can be removed from the circular knitting machine.

Figure 11:
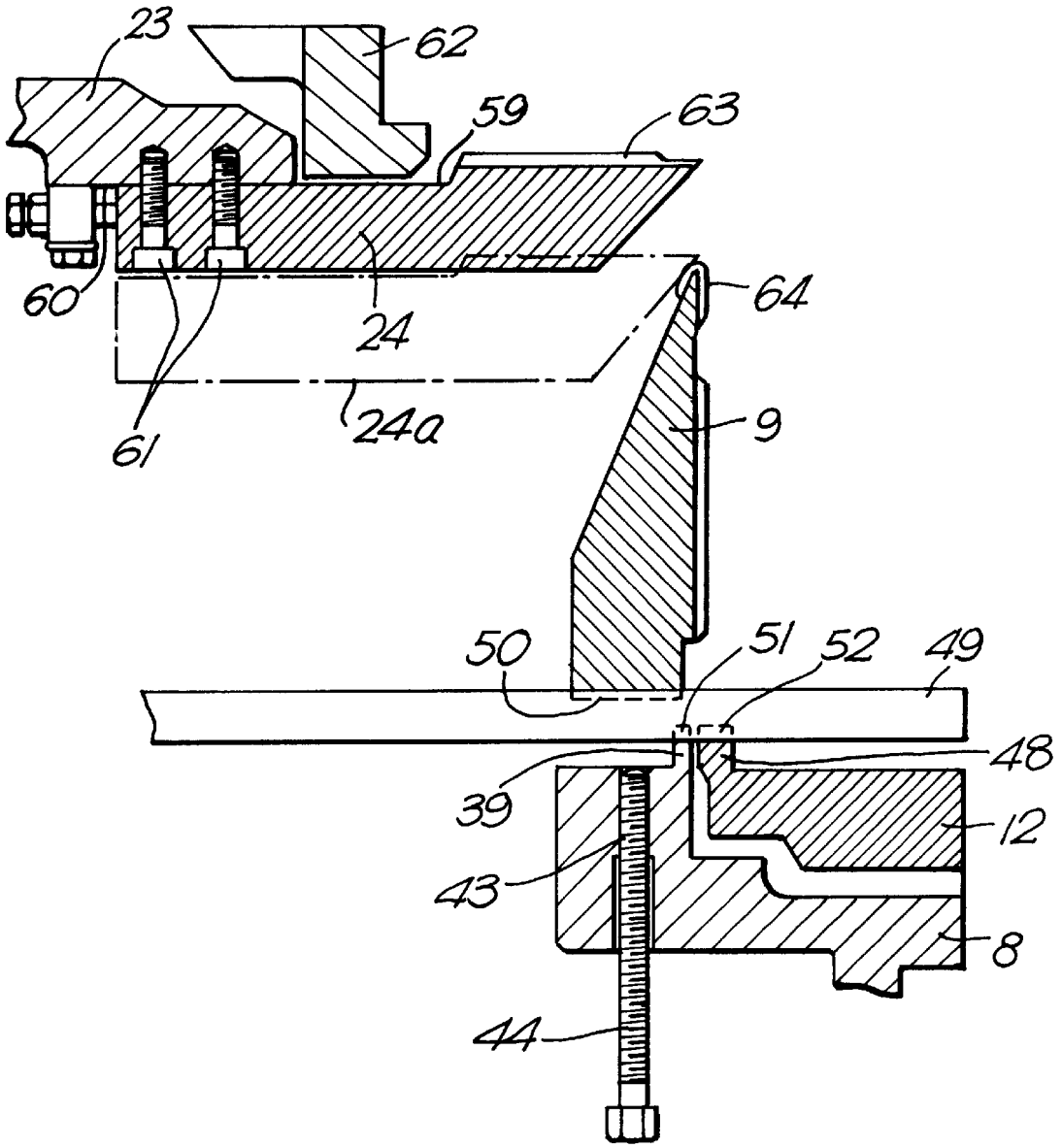
FIG. 11 is a cross-sectional view according to FIGS. 6 to 8 of an embodiment of a needle cylinder segment taken along the section lines XI—XI of FIG. 9.

The dial 24 bears in the assembled state with an upper bearing surface 59 (FIG. 11) on a lower end surface 60 of the supporting plate 23 and is attached with screws 61 suspended from the supporting plate 23. If it is desired to disassemble the dial 24 also with the needle cylinder 9, it is only required to loosen the screws 61 and to place the dial 24 on the upper side of the needle cylinder as is shown in FIG. 11 with the dashed line 24*a*.

So that the simultaneous mounting and demounting of the dial 24 is not prevented by projecting parts, the height of the spacer 35 in the direction of axis 10 is selected or dimensioned so that the highest point of the unit comprising the needle cylinder 9 and the dial 24 placed on it is under the lower end surface 60 of the supporting plate 23 after removing the spacer 35 and placing the needle cylinder 9 securely on the guide rails 49. If it should be possible to only assemble and/or disassemble the needle cylinder 9, its loop knocking-over edge must lie below the lowest point of the dial 2 after placing it on the guide rails 49. Since in this embodiment the dial cam 25 is attached to a lower flange-like dial cam support 62 on the lower end of the carrier tube 15 which support overlaps the supporting plate 23, it does not matter whether a surface 63 (FIG. 11) of the dial 24 formed by the crosspieces for the dial needles is in the same plane as the bearing surface 59 or above or below that plane, because the necessary amount of lowering of the needle cylinder 9 can be determined by the height of the spacer 35. Apart from this the arrangement is designed so that the carrier shaft 18 can be brought into its highest position before assembly or disassembly of the needle cylinder 9 by means of the adjusting element 29 and that by this the comb spacing d (FIG. 3) can made so large that the needle cylinder 9 can be raised sufficiently for removal of the spacer 35 and can then be removed with or without the dial 24 according to choice as required.

Finally it can be desired to arrange an assembly protecting element 64 (FIG. 11) between the dial 24 and the needle cylinder 9 before the dial 24 is placed on the needle cylinder 9. In order to simplify this process the needle cylinder can be lowered first into a position which is below its own assembly position prior to lifting it up again by screwing out the lifting screws 44 as required. In this case the guide rails 49 are first inserted after insertion of the assembly protecting element 64.

The parts in the embodiment according to FIGS. 12 to 15, which are the same as those in the previous embodiments, are given the same reference numbers. The embodiment of FIGS. 12 to 15 is currently the most preferred embodiment. Moreover only those parts which are essential for the assembly and disassembly of the needle cylinder 9 and, if needed, of a dial 67 are shown analogous to FIG. 11.

Figure 6:
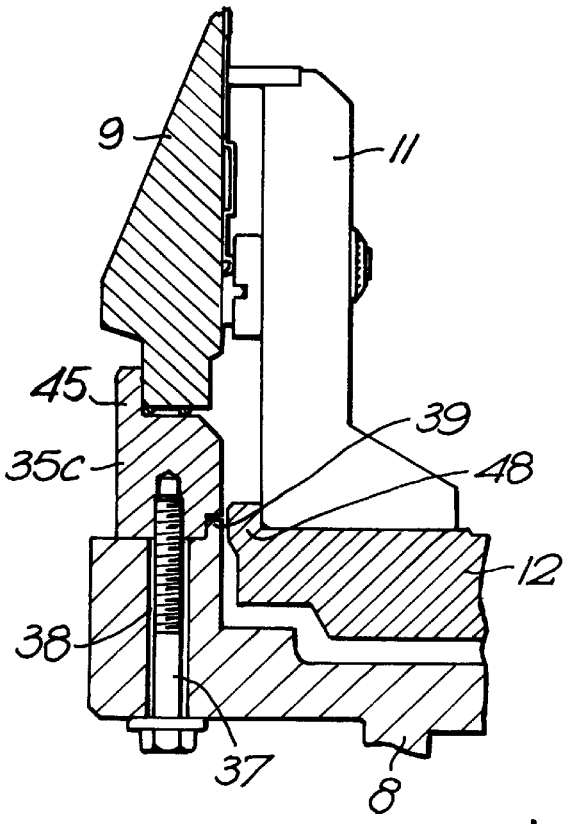
FIGS. 6 to 8 are detailed vertical cross-sectional views showing embodiments of needle cylinder segments from the needle cylinder shown in FIGS. 4 and 5 taken along the sections lines VI—VI, VII—VII and VIII—VIII shown in FIGS. 4 and 5.
Figure 7:
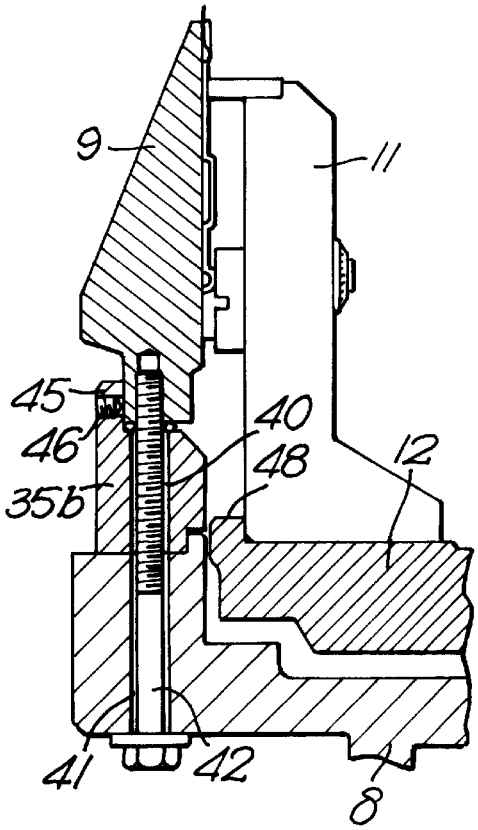
Figure 8:
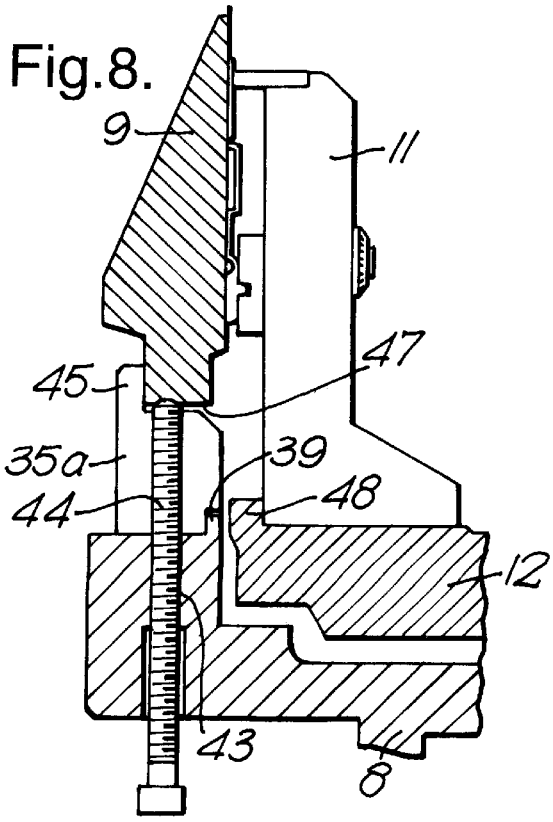
Figure 9:
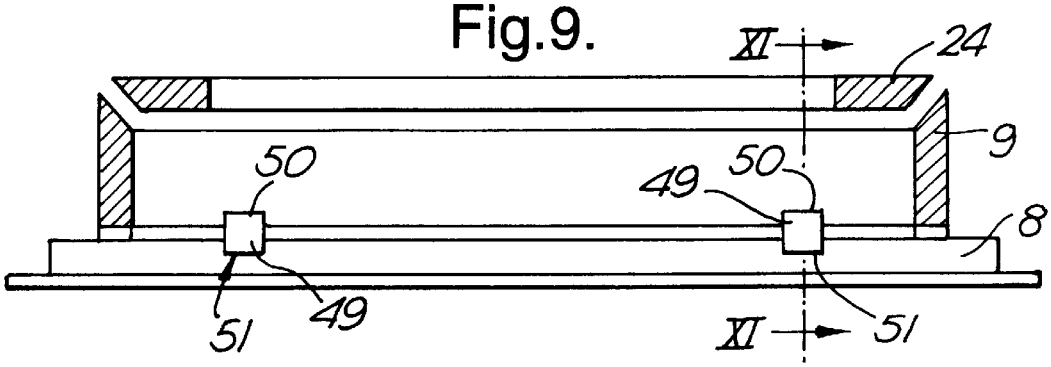
FIG. 9 is a detailed coarse schematic vertical cross-sectional view only through the dial and needle cylinder structure taken along the section line IX—IX of FIG. 1.
Figure 10:
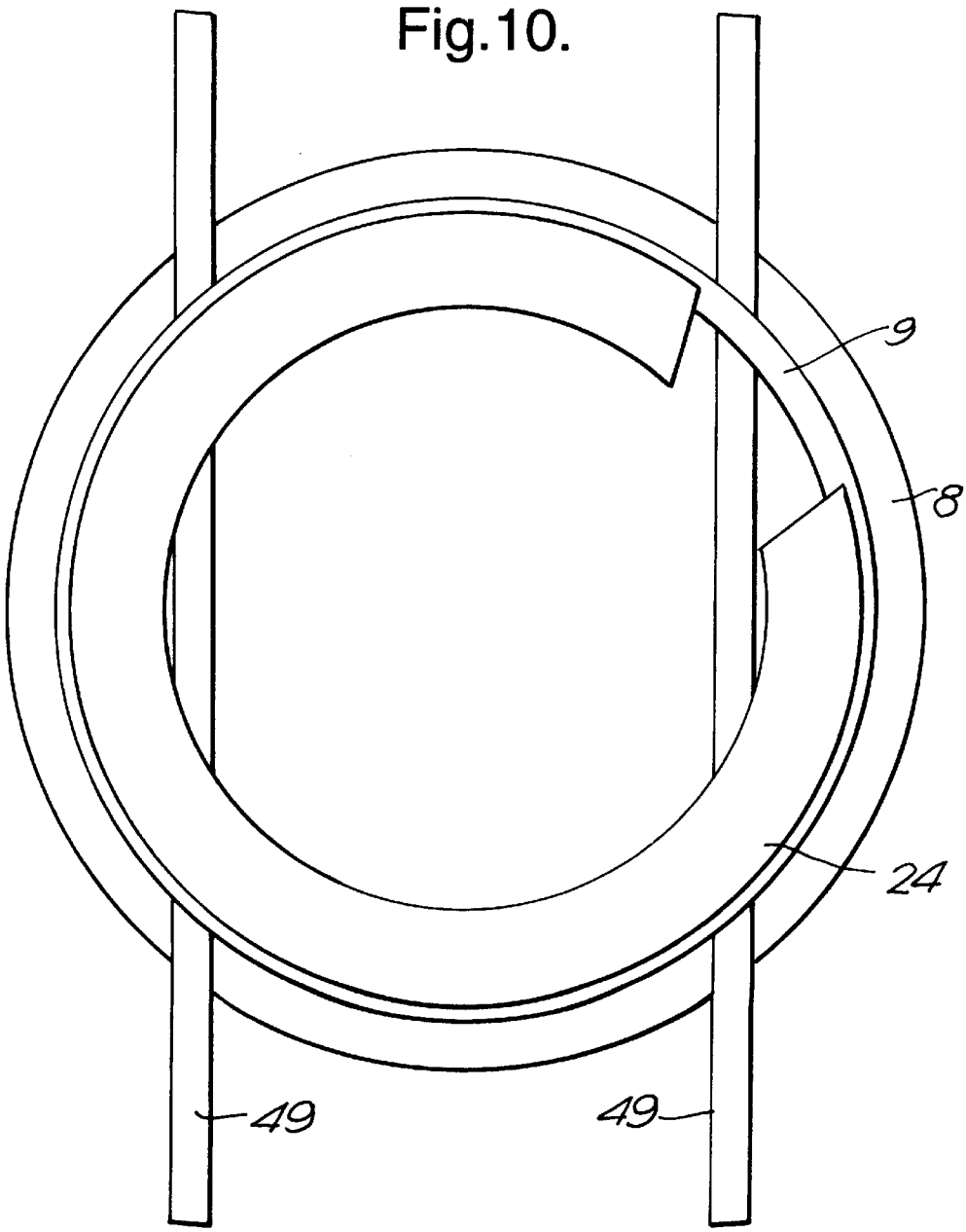
FIG. 10 is a top plan view of the arrangement of FIG. 9.

The needle cylinder 9 in contrast to the embodiment of FIGS. 1 to 11 advantageously is supported on a supporting surface 69 (FIG. 13) of a carrier 70, which is provided with a centering ring 71 adjustable in its height on its inner side, by means of a spacer 68 which comprises at least two parts in a circumferential direction. This centering ring 71 has elongated holes 72, through which attaching screws 73 are screwed into the carrier ring 70, which may hold the centering ring 71, if tightened, in the state shown in the drawing at a height (FIG. 12) at which it extends beyond the lower bearing surface of the needle cylinder 9, while in the loosened state they allow a lowering of the centering ring 71 along the elongated holes into a position (FIG. 13) in which it is completely under the needle cylinder 9. The centering ring 71 can be closed in the circumferential direction of the needle cylinder 9 or it can comprise individual segments separated by gaps 71*a* (FIG. 13), and has in a portion which extends in FIG. 12 beyond the lower edge of the needle cylinder 9, radially threaded holes and centering screws 74 in them whose function is identical with the function of the centering screws 46 (FIG. 6).

The carrier ring 70 is provided with upwardly open U-shaped guide grooves 75 in which in analogy to the embodiment of FIGS. 1 to 11 at least two suitable lifting and guiding rails 76 are inserted or are insertable parallel to each other. The centering ring 71 has U-shaped grooves 77 (FIG. 13) which are aligned with the guide grooves 75 and allow a raising or lowering of the centering ring also with the lifting and guiding rails 76 inserted.

The lifting and guiding rails 76 have a rounded and in the embodiment shown an oval cross-section. The dimensions of the cross-sections are selected so that the lifting and mounting rails 76, if the needle cylinder 9 is in its normal operating position, can substantially only be inserted into the guide grooves 75 with a position in which their smallest diameter is parallel to the axis 10 (FIG. 3) of the needle cylinder 9, whereby they support themselves with one side on the bottom of the associated guide grooves 75, while their diametrical opposite sides are both somewhat above the upper side of the carrier ring 70 (dashed line 78 in FIG. 12) and slightly below the lower edge of the needle cylinder (line 79 in FIG. 12) because of the presence or the spacer 68 or within a guide groove 80 provided in the needle cylinder 9.

Figure 12:
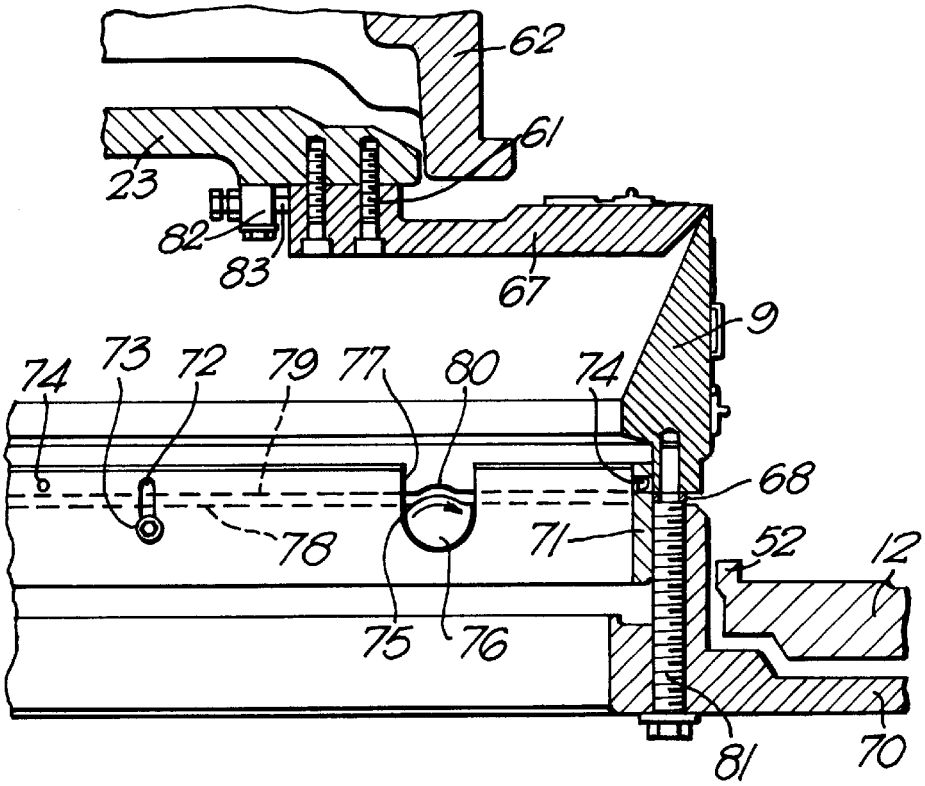
FIGS. 12 to 15 are cutaway cross-sectional views through a needle cylinder and dial structure in a second embodiment of the circular knitting machine in different stages of disassembling the needle cylinder and dial structure analogous to FIGS. 6 to 8 and 11.
Figure 13:
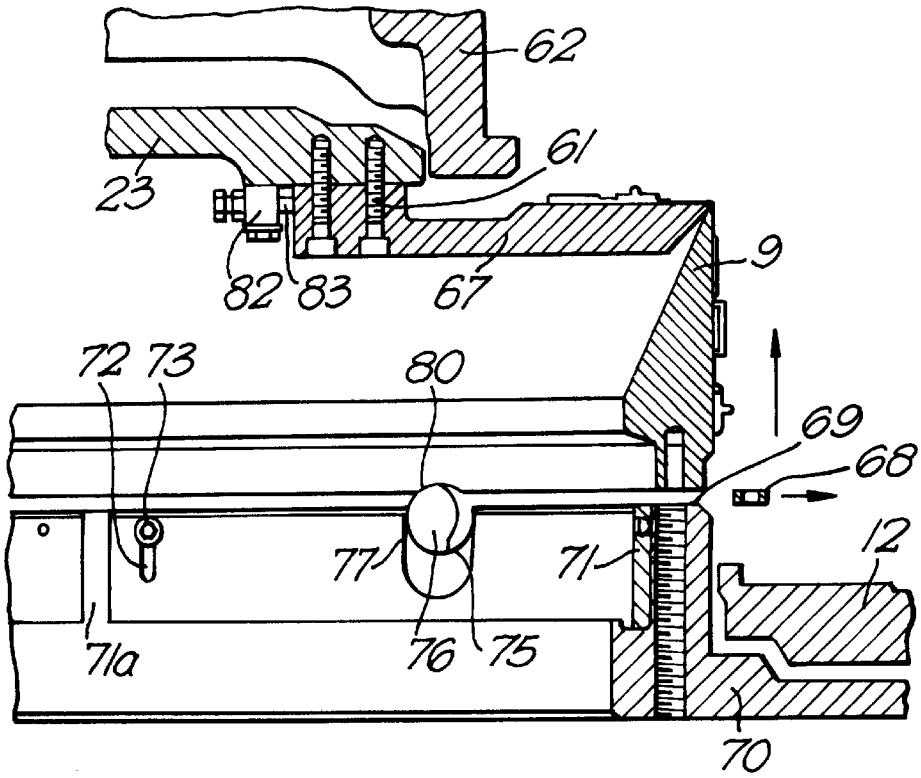
Figure 14:
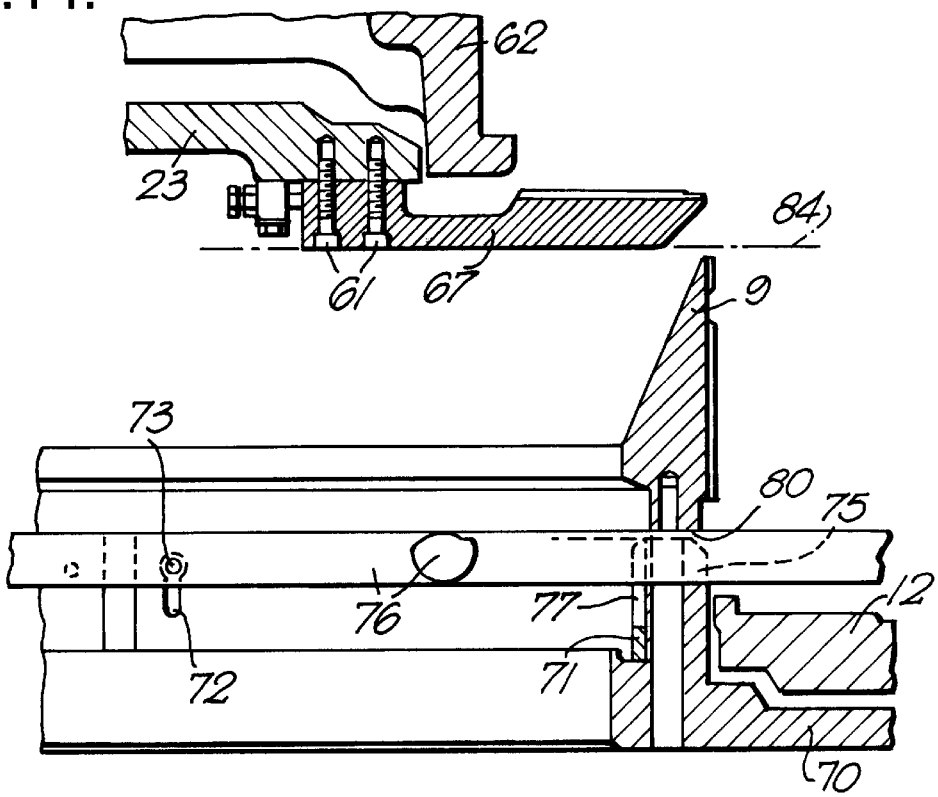

The assembly and disassembly of the needle cylinder 9 of the circular knitting machine according to FIGS. 12 to 14 is explained in the following.

First the centering screws 74 are screwed out and the lifting and guiding rails 76 are inserted into the guide grooves 75 if they are not permanent parts of the circular knitting machine. The guide frame 53 shown in FIGS. 1 and 2 can be used. After that the attachment screws 73 are loosened so that the centering ring 71 can arrive at the lower position shown in FIG. 13 because of gravity. The attachment screws 81 corresponding to the attachment screws 42 (FIG. 7) are removed from the needle cylinder 9 and the lifting and guiding rails 76 are rotated for example in the direction indicated with the arrow in FIG. 12, whereby its large diameters gradually come into in the effective range of the lower edge of the needle cylinder and contact it. On further rotation of the lifting and guiding rails 76 about as much as about 90° its larger diameter is parallel to the needle cylinder axis whereby the sides diametrically opposite to the bottom of the guide grooves 75 hold the needle cylinder 9 in a slightly raised position, which is sufficient in order to remove the spacer 68 as indicated by the arrow in FIG. 13. Also in this embodiment the needle cylinder 9 only needs to be raised a few tenths of a millimeter. The spacer 68 then can be made of spacing pieces formed like a type of washer which can be projected by the attachment screws 81 (FIG. 12) and for example have open slots on one side, so that it can be pushed in or pulled out also with the attachment screws 81 still screwed in. Because of that it can be used also for axial centering of the needle cylinder 9.

The lifting and guiding rails 76 can be rotated again about 90°, whereby the needle cylinder 9 is lowered again. Since the smaller diameter of the lifting and guiding rails 76 is selected so that they end in a position somewhat above the upper edge of the carrier ring 70, the needle cylinder 9 now can be removed laterally analogously to the embodiment according to FIGS. 1 to 9 (FIG. 14), without colliding with some of the parts of the circular knitting machine. It is guided with the guide grooves 80 on the lifting and guiding rails 76. Apart from this the performed process steps are analogous to those for the embodiment of FIGS. 1 to 11, and only the lifting function of the lifting screws 44 is replaced by the lifting function of the lifting and guiding rails 76. In other words in the embodiment according to FIGS. 12 to 14 the lifting and guiding rails 76 is a means for shifting or moving the needle cylinder 9 in an axial direction so that the needle cylinder 9 can take at least one normal operating position (FIG. 12) and an assembly position (FIG. 14) allowing assembly or disassembly. It is understood that the outer shape of the lifting and guiding rails, as shown in FIGS. 12 and 13, can be selected other than oval and especially so that the desired operations can be performed with a small as possible effort or applied force.

Figure 15:
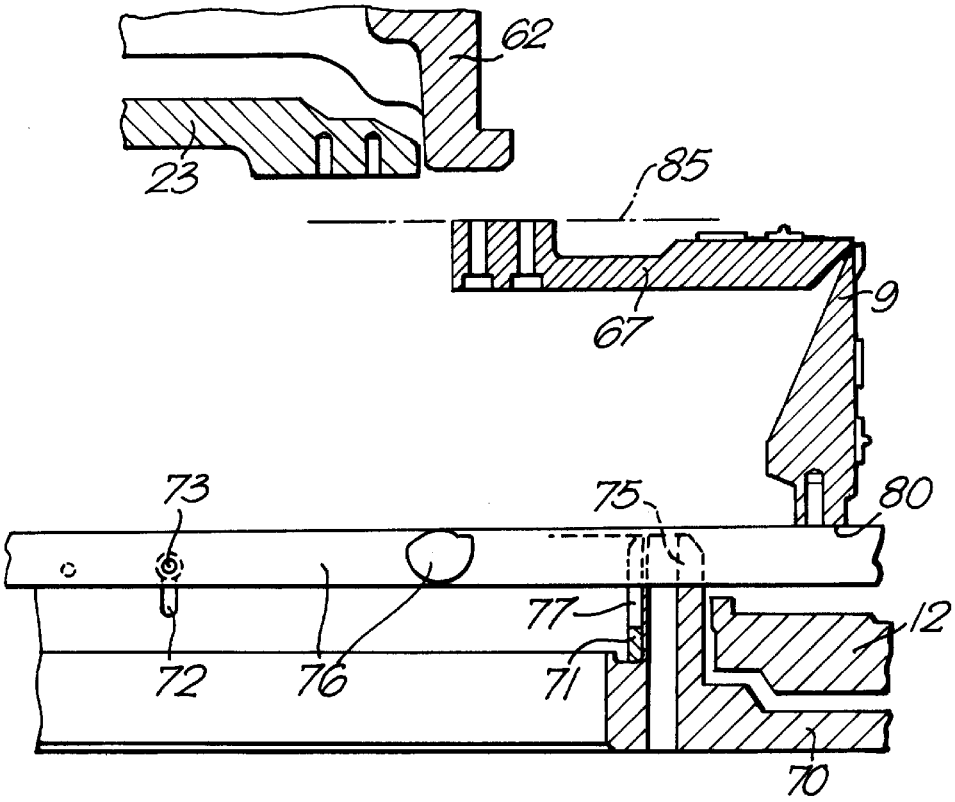

FIG. 14 shows the position of the dial 67 in a state mounted on the supporting plate 23 and, e.g., in its highest axial position. The arrangement is thus set forth so that its lower edge lies in a plane 84 which is arranged above the upper edge of the needle cylinder 9 so that the needle cylinder 9 can be radially removed without the ribbed ring 67. Alternatively it is also possible to loosen the screws 61 and after that to place the dial 67 on the upper edge of the needle cylinder 9 and to remove the dial together with it radially, as shown in FIG. 15. In this case the upper edge of the ribbed ring 67 is arranged in a plane 85 which is below the lower edge of the supporting plate 23 and 62.

Figure 16:
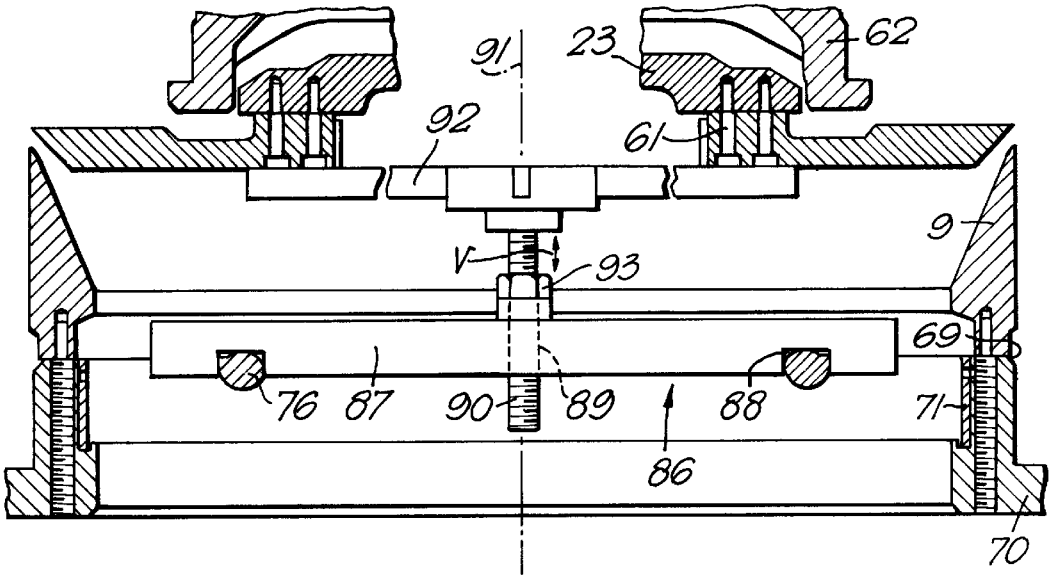
FIGS. 16 and 17 are schematic longitudinal views through the knitting machines according to FIGS. 1 and 2 and 12 to 15 showing an additional mounting device for a dial.
Figure 17:
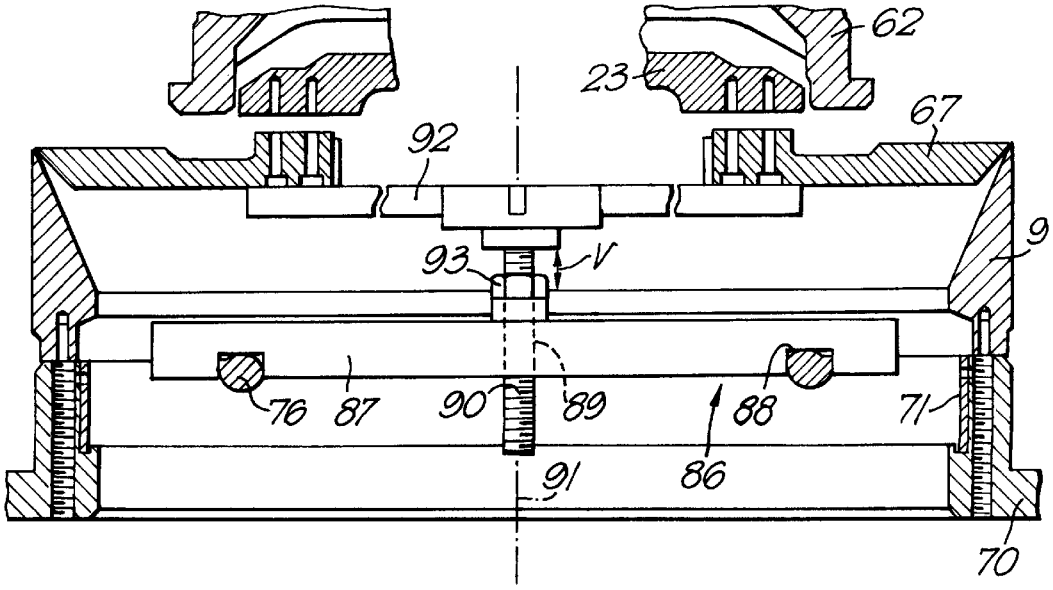

In an embodiment shown in FIGS. 16 and 17, in which the same parts are provided with the same reference numbers as in the previous embodiments, a means for mounting the dial is provided in addition to a guide or assembly device for adjusting the needle cylinder 9. This means contains an understructure 86, which for example is formed by at least one supporting rail 87, which is arranged transversely to the guide rails 76 and can be placed on them. The supporting rail 87 has at least two preferably U-shaped grooves 88 spaced from each other and placed on the guide rails 76 from above for enclosing the mounting rails 76 closely in the assembled state (see also FIGS. 1 and 2) so that they are firmly seated on them. The understructure 86 or the supporting rail 87 has a cylindrical passage 89, in which a threaded spindle 90 is vertically slidable and according to a preferred embodiment also rotatable. The threaded spindle 90 is arranged in the assembled state of the understructure 86 parallel to an axis 91, which corresponds to the axis 10 in FIG. 3, and is attached to a supporting frame 92 with an end extending above the understructure 86, the cross-section of frame 92 being larger than that of a standard central opening formed in the dial 67. Moreover a nut 93 is screwed onto the threaded spindle 90 and bears from above on an edge section of the understructure surrounding the passage 89 or on the supporting rail 87. Because of that it is possible to move the supporting frame 92 up and down parallel to the axis 91 and in the direction of the double arrow v relative to the understructure and also to rotate it about the axis 91. Thus the up and down motion can occur by rotation of the nut 93 with the supporting frame 92 held stationary, whereas the rotation can be made by rotating the supporting frame 92 with the nut 93 held stationary. Of course other means for rotation and/or back and forth motion of the supporting frame could be provided.

The adjustment of the dial 67 can be performed as follows with the aid of the assembly device according to FIGS. 2, 16 and 17.

The supporting frame 92 is moved upward by operation of the nut 93 after putting the understructure 86 on the guide rails 76 until the frame 92 contacts the underside of the dial 67 and supports it (FIG. 16). After the release of the screws 61 the supporting frame 92 is lowered by operating the nut 93 again until the dial 67 contacts or bears on the upper edge of the needle cylinder 9 (FIG. 17). Subsequently the supporting frame 92 is lowered and if necessary removed from the guide rails 76, before the needle cylinder 9 is moved out or removed from the machine radially together with the dial 67. Alternatively it would also be possible to at first remove the needle cylinder 9 from the machine, after that to deposit the dial 67 on the supporting frame 92 and then to move the understructure 86 radially outward on the guide rails 76, i.e. to disassemble the dial 67 independently from the already disassembled needle cylinder 9. An arrangement, which is not shown in FIGS. 16 and 17, analogous to the embodiment shown in FIG. 11 to 15 would be useful for this in order to guarantee that a sufficient free space is provided between the upper edge of the needle cylinder 9 and the lower edge of the dial 67. The same goes for the assembly, i.e. the dial 67 could either first be assembled and then the needle cylinder 9 since the previously described process steps could be carried out completely in reverse order or at first a unit comprising the dial 67 and the needle cylinder 9 could be positioned in the machine and then the assembly device could be brought into position in order to lift the dial 67 and secure it on the supporting plate 23.

This type of assembly device is especially preferably when the supporting frame 92 is mounted rotatable on the understructure 86 in the described manner. In this case the screw holes of the dial 67 can easily be aligned by rotation of the supporting frame 92 with the threaded passages of the supporting plate 23, prior to screwing in the attachment screws 61. This type of alignment of the dial 67 is not or only possible with difficulty when it rests on the needle cylinder 9 or on the assembly protecting device 64. The weight of the dial 67 is supported from the supporting frame 92 when the assembly device according to the invention is used so that a rotation of the dial 67 is easily possible.

The embodiment according to FIGS. 16 and 17 has the advantage over the other embodiments that it allows a replacement of the needle cylinder 9 with or without simultaneous replacement of the dial 67 according to the particular application. Also an assembly aid is present which also simplifies the reassembly of the dial 67 when the needle cylinder is disassembled. Thus it is clear that the assembly device can be used as an additional structural component or can be assembled permanently in the circular knitting machine. In the latter case the arrangement is set up so that the understructure 86 is assembled at a position under the machine frame so that the supporting frame 92 can be lowered below the bearing surface 69 of the supporting ring 70 and/or the lower edge of the needle cylinder 9 located in its assembled position. Moreover the described assembly device can be used in a suitable way also in the embodiment according to FIGS. 1 to 11.

The invention is not limited to the embodiments described which can be varied in many ways. For example it would also be possible to form those parts of the carrier ring 8 and/or 70 which support the needle cylinder 9 as separate elements and to provide them with a outer threaded section which is screwed into an inner threaded section provided in the carrier ring 8 and/or 70, whereby the threaded sections are formed so that a rotation of the elements carrying the needle cylinder causes a raising and/or lowering of the needle cylinder in a direction of the axis 10 (FIG. 3). In this case the spacer 35 and/or 68 can be eliminated and the required adjusting motion can be performed by rotation of the additional elements. Also other means for adjustment of the needle cylinder 9 in the axial direction are usable, for example in the form of a hydraulic or pneumatic cylinder, an eccentric cam or the like arranged between the needle cylinder and the carrier ring 8,70 and provided in addition to the spacer 35,68 or instead of it.

Furthermore it would be possible to provide the carrier ring 8 and/or 70 on its upper end and/or the needle cylinder 9 on its lower end with a mounting flange which should be provided for the required compensation of diameters in the vicinity of the bearing surface 47 (FIG. 8) for the case in which needle cylinders with different diameters are provided. Moreover the described adjusting device also can be provided in a circular knitting machine in which the needle cylinder and the component 2 are arranged stationary while the cams 11,25 (FIG. 3) are rotated. Furthermore an embodiment in which the surfaces formed by the webs of the dial are lower than the mounting surface of the dial 67 is shown in FIGS. 12 to 15 in contrast to that of FIGS. 6 to 8 and 11. Also the supporting plate 23 can in contrast to FIG. 3 be a separate releasable part connected with the carrier shaft 18. Several bearing blocks 82 may be provided for radial centering of the dial, as shown in FIGS. 12 to 13, and be releasably attached with screws or the like with the underside of the supporting plate 23 and have radially acting centering screws 83 bearing on the dial 67 and acting analogous to the centering screws 46 (FIG. 7) or 7 (FIG. 12) for the needle cylinder 9. For the case in which the dial 67 should be disassembled the bearing blocks 82 are appropriately previously removed so that they do not hinder the lateral removal of the dial 67. Apart from that the guide rails 49 and/or 76 can be replaced by other assembly and/or disassembly aids, and the operating position of the needle cylinder 9 can be axial higher or lower than the assembly position or can lie in the same plane as it, a lower lying assembly position being especially preferred. Finally it is understood that the different parts of the circular knitting machine can be used in other combinations than those shown and described and for the purpose of exchanging the needle cylinder and the dial.

The disclosure in German Patent Application 196 53 761.4 of Dec. 20, 1996 is incorporated here by reference. This German Patent Application describes the invention described hereinabove and claimed in the claims appended hereininbelow and provides the basis for a claim of priority for the instant invention under 35 U.S.C. 119.

While the invention has been illustrated and described as embodied in a circular knitting machine with an exchangeable needle carrier, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

What is claimed is:

1. A circular knitting machine comprising a machine frame (1); a supporting ring (8, 70) mounted on the machine frame (1); a needle cylinder (9), said needle cylinder (9) being supported on the supporting ring and having a needle cylinder axis (10), an upper edge and a lower edge; a carrier shaft (18) mounted in the machine frame (1) coaxial to the needle cylinder axis (10); a component (24) mounted on a lower end of the carrier shaft; and means **(35, 35*a*, 35*b*, 35*c*, 68) for moving the needle cylinder (9) relative to the component (24) in a direction of the needle cylinder axis (10) so that the needle cylinder is movable into an operating position and an assembly position allowing assembly and/or disassembly by motions of the needle cylinder (9)** substantially perpendicular to the needle cylinder axis.

2. The circular knitting machine according to claim 1, wherein the supporting ring (70) is provided with centering elements (74) for the needle cylinder (9).

3. The circular knitting machine according to claim 1, wherein said means (35, 35*a*, 35*b*, 35*c*, 68) for moving the needle cylinder (9) relative to the component (24) in the direction of the needle cylinder axis (10) includes a supporting element being mounted on the lower edge of the needle cylinder and being rotatably mounted on the supporting ring and wherein said supporting element has an outer threaded portions screwed into an interior threaded portion of the supporting ring.

4. A circular knitting machine comprising a machine frame (1), a supporting ring (8, 70) mounted on the machine frame (1), a needle cylinder (9) supported on the supporting ring, said needle cylinder having a needle cylinder axis (10) and an upper and a lower edge, a carrier shaft (18) mounted in the machine frame (1) coaxial to the needle cylinder axis (10), a component (24) mounted on a lower end of the carrier shaft, and means (35, 35*a*, 35*b*, 35*c*, 68) for moving the needle cylinder (9) relative to the component (24) in the direction of the needle cylinder (10) so that the needle cylinder can be disassembled or assembled by motions substantially perpendicular to the needle cylinder axis and so that the needle cylinder is movable into an operating position and an assembly position allowing said assembly and/or disassembly, at least two guide rails (49, 76) mounted on the supporting ring (8, 70) and/or a cam plate (12) associated with the needle cylinder (9), and wherein the assembly position is defined by said at least two guide rails (49, 76) mounted on the supporting ring (8, 70) and/or the cam plate (12), and said needle cylinder (9) is placed on said at least two guide rails (49, 76) in the assembly position.

5. The circular knitting machine according to claim 4, wherein the assembly position of the needle carrier is not below a plane passing through an upper side of the supporting ring (8,70) and/or the cam plate (12).

6. The circular knitting machine according to claim 4, wherein guide grooves (50–52; 75; 80) for said at least two guide rails (49,76) are provided in said lower edge of aid needle cylinder and/or an upper side of said supporting ring (8,70) and/or said cam late (12).

7. The circular knitting machine according to claim 4, further comprising a guide frame (53) for supporting portions of said at least two guide rails (49,76) extending radially beyond said machine frame (1) and wherein said guide frame (53) rests or bears on said machine frame (1).

8. A circular knitting machine comprising a machine frame (1), a supporting ring (8, 70) mounted on the machine frame (1), a needle cylinder (9) supported on the supporting ring, said needle cylinder having a needle cylinder axis (10) and an upper and a lower edge, a carrier shaft (18) mounted in the machine frame (1) coaxial to the needle cylinder axis (10), a component (24) mounted on a lower end of the carrier shaft, and means (35, 35*a*, 35*b*, 35*c*, 68) for moving the needle cylinder (9) relative to the component (24) in the direction of the needle cylinder (10) so that the needle cylinder can be disassembled or assembled by motions substantially perpendicular to the needle cylinder axis and so that the needle cylinder is movable into an operating position and an assembly position allowing assembly and/or disassembly, wherein the component is a dial (24, 26) and a spacing between the operating position and the assembly position is sufficiently large that the needle cylinder (9) is removable from the machine frame (1) along with said dial (24, 26) on an upper side of said needle cylinder (9).

9. The circular knitting machine according to claim 8, wherein said dial (24,67) is releasably attached to a lower side of a dial supporting carrier (23) provided on the lower end of said carrier shaft (18).

10. The circular knitting machine according to claim 9, wherein said dial supporting plate (23) and said carrier shaft (18) comprise parts releasably connected with each other.

11. A circular knitting machine comprising a machine frame (1), a supporting ring (8, 70) mounted on the machine frame (1), a needle cylinder (9) supported on the supporting ring, said needle cylinder having a needle cylinder axis (10) and an upper and a lower edge, a carrier shaft (18) mounted in the machine frame (1) coaxial to the needle cylinder axis (10), a component (24) mounted on a lower end of the carrier shaft, and means (35, 35*a*, 35*b*, 35*c*, 68) for moving the needle cylinder (9) relative to the component (24) in the direction of the needle cylinder (10) so that the needle cylinder can be disassembled or assembled by motions substantially perpendicular to the needle cylinder axis and so that the needle cylinder is movable into an operating position and an assembly position allowing assembly and/or disassembly, said means (35, 35*a*, 35*b*, 35*c*, 68) for moving the needle cylinder (9) relative to the component in the direction of the needle carrier axis (10) includes a removable spacer (35, 68) by which the needle carrier is supported in said operating position on the supporting ring (8, 70).

12. The circular knitting machine according to claim 11, wherein said means (35,35*a*,35*b*,35*c*,68) for moving the needle cylinder (9) relative to the component in the direction of the needle carrier axis (10) includes lifting screws (44) by means of which said needle cylinder (9) is liftable into a spacer removal position allowing removal of said spacer (35).

13. The circular knitting machine according to claim 11, wherein said means (35,35*a*,35*b*,35*c*,68) for moving the needle cylinder (9) relative to the component in the direction of the needle carrier axis (10) includes at least two lifting and guiding rails (76) having unround cross-sections mounted between the needle cylinder (9) and the supporting ring (70) and/or a cam plate (12), by means of which said needle cylinder (9) is liftable into a spacer removal position allowing removal of said spacer (68).

14. The circular knitting machine according to claim 11, wherein the spacer (35) is provided with centering means (46) for the needle cylinder (9).

15. The circular knitting machine according to claim 11, wherein the spacer (35) comprises a plurality of spacing pieces (35*a*,35*b*,35*c*) arranged around a circumference of said supporting ring (8), and further comprising attachment screws (37) for releasably attaching said spacing pieces with said supporting ring (8).

16. A circular knitting machine comprising a machine frame (1), a supporting ring (8, 70) mounted on the machine frame (1), a needle cylinder (9) supported on the supporting ring, said needle cylinder having a needle cylinder axis (10) and an upper and a lower edge, a carrier shaft (18) mounted in the machine frame (1) coaxial to the needle cylinder axis (10), a component (24) mounted on a lower end of the carrier shaft, and means (35, 35*a*, 35*b*, 35*c*, 68) for moving the needle cylinder (9) relative to the component (24) in the direction of the needle cylinder (10) so that the needle cylinder can be disassembled or assembled by motions substantially perpendicular to the needle cylinder axis and so that the needle cylinder is movable into an operating position and an assembly position allowing assembly and/or disassembly, the wherein supporting ring (70) is provided with centering elements (74) for the needle cylinder (9), and the centering elements (74) are provided on a centering ring (71) which is mounted on the supporting ring (7) and movable parallel to the needle cylinder axis.

17. The circular knitting machine according to claim 16, wherein the centering ring (71) comprises at least two centering ring segments.

18. A circular knitting machine comprising a machine frame (1), a supporting ring (8, 70) mounted on the machine frame (1), a needle cylinder (9) supported on the supporting ring, said needle cylinder having a needle cylinder axis (10) and an upper and a lower edge, a carrier shaft (18) mounted in the machine frame (1) coaxial to the needle cylinder axis (10), a component (24) mounted on a lower end of the carrier shaft, and means **(35, 35*a*, 35*b*, 35*c*, 68) for moving the needle cylinder (9) relative to the component (24) in the direction of the needle cylinder (10)** so that the needle cylinder can be disassembled or assembled by motions substantially perpendicular to the needle cylinder axis and so that the needle cylinder is movable into an operating position and an assembly position allowing assembly and/or disassembly, and an assembly device for moving the component up and down.

19. The circular knitting machine according to claim 18, wherein the assembly device has an axially slidable supporting frame (92) for the component.

20. The circular knitting machine according to claim 19, wherein the supporting frame (92) is rotatably mounted in the assembly device.

21. The circular knitting machine according to claim 18, wherein the assembly device has an understructure (86) mounted on at least two guide rails (49,76).

* * * * *